US010082280B2

(12) United States Patent
Belliveau et al.

(10) Patent No.: US 10,082,280 B2
(45) Date of Patent: Sep. 25, 2018

(54) THEATRE LIGHT APPARATUS AND METHOD INCORPORATING A PLURALITY OF LIGHT SOURCES WITH ANTI-COLLISION

(71) Applicants: Richard S. Belliveau, Austin, TX (US); Aaron Brown, Cedar Park, TX (US); David Peck, Austin, TX (US)

(72) Inventors: Richard S. Belliveau, Austin, TX (US); Aaron Brown, Cedar Park, TX (US); David Peck, Austin, TX (US)

(73) Assignee: ELECTRONIC THEATRE CONTROLS, INC., Middleton, WI (US)

( * ) Notice: Subject to any disclaimer, the term of this patent is extended or adjusted under 35 U.S.C. 154(b) by 151 days.

(21) Appl. No.: 15/242,872

(22) Filed: Aug. 22, 2016

(65) Prior Publication Data

US 2018/0051869 A1 Feb. 22, 2018

(51) Int. Cl.

| | |
|---|---|
| ***F21V 21/15*** | (2006.01) |
| ***F21V 21/30*** | (2006.01) |
| ***F21V 25/02*** | (2006.01) |
| *F21V 7/00* | (2006.01) |
| *F21W 131/406* | (2006.01) |
| *F21Y 115/10* | (2016.01) |
| *F21Y 113/17* | (2016.01) |

(52) U.S. Cl.

CPC ..... *F21V 21/15* (2013.01); *F21V 21/30* (2013.01); *F21V 25/02* (2013.01); *F21V 7/0091* (2013.01); *F21W 2131/406* (2013.01); *F21Y 2113/17* (2016.08); *F21Y 2115/10* (2016.08)

(58) Field of Classification Search

CPC ..... F21V 21/30; F21V 21/15; F21V 7/0091; F21V 25/00; F21V 25/02; F21W 2131/406

See application file for complete search history.

(56) References Cited

U.S. PATENT DOCUMENTS 4,837,665 A * 6/1989 Hoyer ..... H05B 37/029 362/233
5,752,766 A 5/1998 Bailey et al.
6,474,837 B1 11/2002 Belliveau
(Continued)

OTHER PUBLICATIONS https://vibs.ch/wp-content/uploads/2016/02/ACR-Mac-Argus-ACL-Lichtfächer.jpe.

*Primary Examiner* — Anh Mai
*Assistant Examiner* — Arman B Fallahkhair
(74) *Attorney, Agent, or Firm* — Walter J. Tencza, Jr.

(57) ABSTRACT

A theatrical apparatus including a first light source, a second light source and a third light source, a computer memory, and a computer processor. Each of the first, second, and third light sources may have current positions; and each may be configured to be remotely operated by the computer processor executing computer operating software to have its current position changed, independent of the other light sources. Data indicating the current position of each of the first, second, and third light sources, including a position count value for each of the first, second, and third light sources, is stored in the computer memory by the computer processor executing the computer operating software. The computer processor may be programmed by the computer operating software to use the position count values prevent collisions between the light sources.

18 Claims, 9 Drawing Sheets

(56) References Cited

U.S. PATENT DOCUMENTS

| | | | | |
|---|---|---|---|---|
| 7,614,766 | B2 * | 11/2009 | Wang | F21V 14/02 248/183.1 |
| 8,641,241 | B2 * | 2/2014 | Farmer | H05B 37/0254 362/368 |
| 2003/0112148 | A1 * | 6/2003 | Belliveau | H04L 12/403 340/12.22 |
| 2015/0016106 | A1 * | 1/2015 | Belliveau | F21V 14/02 362/233 |
| 2016/0245490 | A1 * | 8/2016 | Jurik | F21V 21/30 |

* cited by examiner

THEATRE LIGHT APPARATUS AND METHOD INCORPORATING A PLURALITY OF LIGHT SOURCES WITH ANTI-COLLISION

FIELD OF THE INVENTION

This invention relates to improved methods and apparatus of lighting devices incorporating a plurality of light sources used on a theatrical stage.

BACKGROUND OF THE INVENTION

Lighting apparatus used on theatrical stages often incorporate a plurality of light sources. U.S. Pat. No. 5,752,766 to Bailey et al. discloses a multi-color focusable LED stage light. A linear actuator is operable to move a base member containing an array of LEDs which in turn cause the LED array to change the direction of the optical axes of a substantial number of LEDs. By deforming the base member 20 in Bailey, the LEDs can be converged or diverged on an area to be illuminated.

U.S. Pat. No. 6,474,837 to Belliveau discloses a beam altering mechanism for a plurality of light sources. An apparatus is disclosed incorporating a plurality of light sources, such as a plurality of lighting emitting diodes, and a beam altering mechanism for altering the light projected by the plurality of light sources. Several mechanisms for altering the beam produced by the plurality of light emitting diodes are disclosed.

U.S. Patent Application 20150016106 to Belliveau et al. discloses a theatre lighting apparatus including a plurality of light emitting modules or light emitting devices contained within a lamp housing each having a remotely controllable pan and tilt axis. The theatre lighting apparatus is also capable of remotely positioning the lamp housing containing the plurality of light emitting modules.

One of the preferred lighting looks on a stage is called a fan effect. A fan effect places a plurality of single lighting instruments arranged to project their projected light beams into a fan. It has also been known to produce a fan effect theatre lighting apparatus called the MacArgus https://vib-s.ch/wp-content/uploads/2016/02/ACR-Mac-Argus-ACL-Lichtfächer.jpe by ACR of Switzerland. While MacArgus could create the desired fan effect each of the nine light beams remained fixed to only one distribution pattern. The MacArgus was known to operate with sealed beam lamps called Aircraft Landing Lamps referred to as "ACL". The ACL lamps were wired in series so that all lamps needed to be on at the same time in order to operate. The MacArgus could not change the color, intensity and position of each nine ACL lamps.

It is desirable to create a novel theatre lighting apparatus that is compact, can create the desired theatrical fan effect and also remotely vary the position of the light beams so more than just a single fixed fan effect can be created thus increasing its economic value.

U.S. patent application to 2015/0016106 to Belliveau et al. illustrates a theatre light that is fairly compact. The light projecting modules 1, 2, 3, 4, 5 and 6 of Belliveau et al., 2015/0016106 can be remotely controlled to vary their position by a user to project light into desired directions. The modules 1, 2, 3, 4, 5 and 6 of Belliveau et al., 2015/0016196 are arranged close together in theatre light 100 in order for the light 100 of Belliveau et al., 2015/0016196 to be compact. The modules pan and tilt movement are physically limited to an approximate +/−fifteen degrees for both pan 670 and tilt 660 of FIG. 6B of Belliveau et al. 2015/0016196. The physical limitation is based upon the overall size of the light 100. It is possible to increase the pan 670 (x axis) and tilt 660 (y axis) however the spacing between modules must be enlarged to prevent collisions. The larger spacing means the physical size of the lamp housing 130 of the theatre light 100 of Belliveau et al. 2015/0016196 must grow in size and thus will reach an undesirable or unmanageable size.

SUMMARY OF THE INVENTION

A novel theatre light apparatus is disclosed, in one or more embodiments of the present invention. The theatre light of one or more embodiments of the present invention incorporates a plurality of light emitting modules contained within a lamp housing each having a remotely controllable pan axis. The theatre light apparatus is also capable of remotely positioning the lamp housing containing the plurality of light emitting modules.

In at least one embodiment, a theatre lighting apparatus is provided comprising: a base, and a lamp housing. The lamp housing may be remotely positioned in relation to the base housing by a motor. The lamp housing may be comprised of a plurality of light emitting modules. The plurality of light emitting modules are individually remotely positionable to project a first light in a first direction, a second light emitting module which is individually remotely positionable to project a second light in a second direction, and a third light emitting module which is individually remotely positionable to project a third light in a third direction. The first direction, the second direction, and the third direction may be different from each other.

The plurality of light emitting modules may be multicolored. Each of the first light emitting module, the second light emitting module, and the third light emitting module may emit light of a different color from each of the other of the first light emitting module, the second light emitting module, and the third light emitting module. Each of the first light emitting module, the second light emitting module, and the third light emitting module may emit light of a different intensity from each of the other of the first light emitting module, the second light emitting module, and the third light emitting module.

The theatre light apparatus may further include a computer or electronic memory. The computer memory may have stored therein a plurality of axis values, at least one axis value for each of the plurality of light emitting devices. The theatre light apparatus may also further comprise an anti-collision operating system that allows the theatre light apparatus to be constructed in a compact manner and with less weight.

In another embodiment, a theatre lighting apparatus is provided comprising a base, a lamp housing, and a master pan and tilt device for remotely positioning the lamp housing in relation to the base. The lamp housing may be comprised of a plurality of light emitting modules. Each of the plurality of light emitting modules may be comprised of a module pan device for remotely directing light emitted by each of the plurality of light emitting modules to a plurality of locations on a projection surface.

In at least one embodiment, a theatrical apparatus is provided comprising a first light source, a second light source and a third light source, a computer memory, and a computer processor. In at least one embodiment, computer operating software is stored in the computer memory and is configured to be executed by the computer processor.

The first light source may have a current position; and the first light source may be configured to be remotely operated by the computer processor executing the computer operating software to have its current position changed from a first position to a second position, independent of the second light source and the second light source and the third light source.

The second light source may have a current position; and the second light source may be configured to be remotely operated by the computer processor executing the computer operating software to have its current position changed from a third position to a fourth position, independent of the first light source and the third light source.

The third light source may have a current position; and the third light source is configured to be remotely operated by the computer processor executing the computer operating software to have its current position changed from a fifth position to a sixth position, independent of the first light source and the second light source.

In at least one embodiment, data indicating the current position of each of the first, second, and third light sources, including a position count value for each of the first, second, and third light sources, is stored in the computer memory by the computer processor executing the computer operating software.

In at least one embodiment, when the second light source is in the fourth position it occupies a first area, and when the first light source is in the first position it occupies at least a portion of the first area.

The position count value of the first light source and the position count value of the second light source may be used to prevent the first light source and the second light source from colliding with each other.

The computer processor may be programmed by the computer operating software to use the position count value of the third light source and the position count value of the second light source to prevent a collision of the third light source and the second light source.

The first light source may be configured to be remotely operated by the computer processor executing the computer operating software to have the current position of the first light source changed from a first position to a second position by a theatrical controller.

The first light source may be configured to be remotely operated by the computer processor executing the computer operating software which includes command protocol, which is the DMX protocol, as transmitted by the theatrical controller to the computer processor.

The first light source may be configured to be remotely operated by the computer processor executing the computer operating software which includes command protocol, which is the Artnet Protocol, as transmitted by the theatrical controller to the computer processor.

In at least one embodiment a theatrical apparatus is provided comprising a base a lamp housing, a first light source, a second light source, and a third light source, a computer memory, and a computer processor. Computer operating software may be stored in the computer memory and is configured to be executed by the computer processor.

The first light source may have a current position; and the first light source may be configured to be remotely operated by the computer processor executing the computer operating software, independent of the second and third light sources, to have its current position changed from a first position to a second position.

The second light source may have a current position; and the second light source may be configured to be remotely operated by the computer processor executing the computer operating software, independent of the first and third light sources, to have its current position changed from a third position to a fourth position.

The third light source may have a current position; and the third light source may be configured to be remotely operated by the computer processor executing the computer operating software, independent of the first and second light sources, to have its current position changed from a fifth position to a sixth position.

The lamp housing may have a front radius. The first, second, and third light sources may be arranged to create a fan effect. The first, second, and third light sources may pivot on the same plane.

In at least one embodiment a method is provided comprising the steps of: changing a current position of a first light source from a first position to a second position remotely by use of a computer processor implementing operating computer software stored in a computer memory; changing a current position of a second light source from a third position to a fourth position remotely by use of the computer processor implementing the operating computer software stored in the computer memory; and changing a current position of a third light source from a fifth position to a sixth position remotely by use of the computer processor implementing the operating computer software stored in the computer memory.

The first light source, the second light source, and the third light source may be part of a theatrical apparatus. The current position of the first light source may be changed without changing the current position of the second and third light sources; the current position of the second light source may be changed without changing the current position of the second and third light sources; and the current position of the third light source may be changed without changing the current position of the second and third light sources.

Data indicating the current position of each of the first, second, and third light sources, including a position count value for each of the first, second, and third light sources, may be stored in the computer memory by the computer processor as programmed by the operating computer software.

When the second light source is in the fourth position it may occupy a first area, and when the first light source is in the first position it may occupy at least a portion of the first area; and wherein the position count value of the first light source and the position count value of the second light source are used to prevent the first light source and the second light source from colliding with each other.

In at least one embodiment, the first light source may be configured to be remotely operated by command protocol, which is the DMX protocol, as transmitted by the theatrical controller to the computer processor.

In at least one embodiment, the first light source may be configured to be remotely operated by command protocol, which is the Artnet Protocol, as transmitted by the theatrical controller to the computer processor.

In at least one embodiment, a method is provided which may include changing a current position of a first light source from a first position to a second position remotely by use of a computer processor implementing a computer program stored in a computer memory; changing a current position of a second light source from a third position to a fourth position remotely by use of a computer processor implementing a computer program stored in a computer memory; and changing a current position of a third light source from a fifth position to a sixth position remotely by use of a computer processor implementing a computer program stored in a computer memory.

The first light source, the second light source, and the third light source may be part of a lamp housing; the lamp housing may be rotatably mounted to a base; the lamp housing may have a front radius; the first, second, and third light sources are arranged to create a fan effect; and the first, second and third light sources may pivot on the same plane.

DETAILED DESCRIPTION OF THE DRAWINGS

Figure 1:
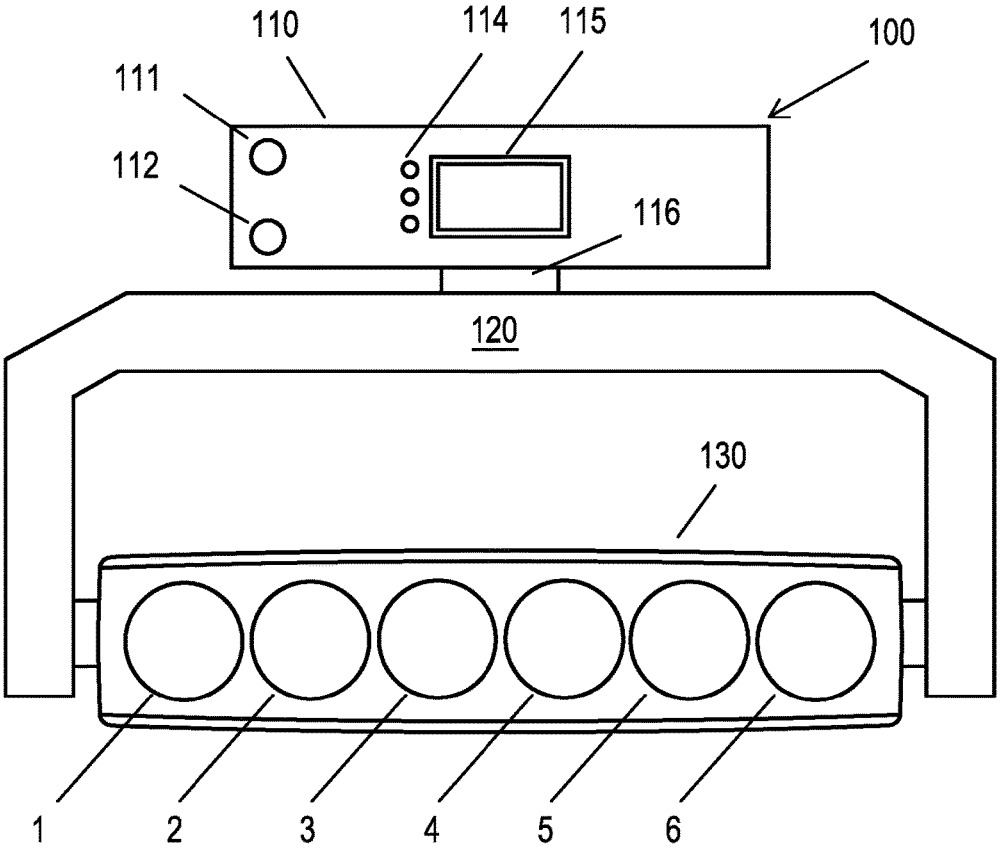
FIG. 1 shows a front planar view, simplified diagram of a theatre lighting apparatus in accordance with an embodiment of the present invention, with a plurality of light emitting modules projecting light parallel to each other in a first state.
Figure 4:
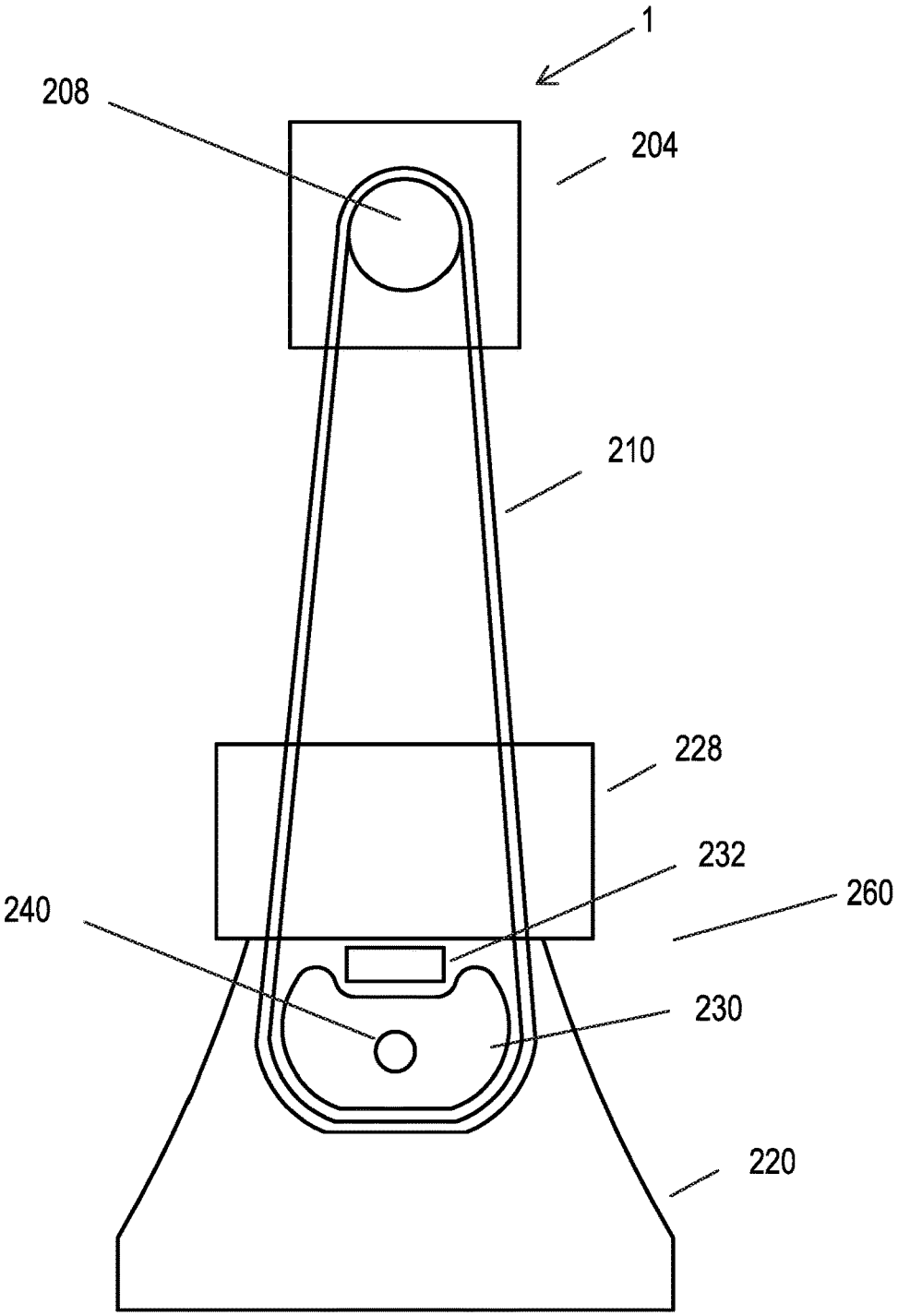
FIG. 4 shows a light emitting module of the plurality of light emitting modules of the theatre lighting apparatus of FIG. 1 that can be driven pan to a plurality of positions by a motor.

The theatre light 100 of FIG. 1 of the present application, in at least one embodiment, is comprised of a plurality of light emitting modules, such as for example, six light emitting modules 1, 2, 3, 4, 5 and 6. FIG. 4 shows a module 1. Each of modules 1-6 may be identical or substantially similar and therefore only module 1 will be described in detail. In at least one embodiment, the module 1 is comprised of a large TIR (total internal reflection) lens 220 of FIG. 4, and a Red, Green, Blue, and White (RGBW) LED array chip 232 of FIG. 4 that cooperates together to create an intense collimated beam of light.

Figure 9:
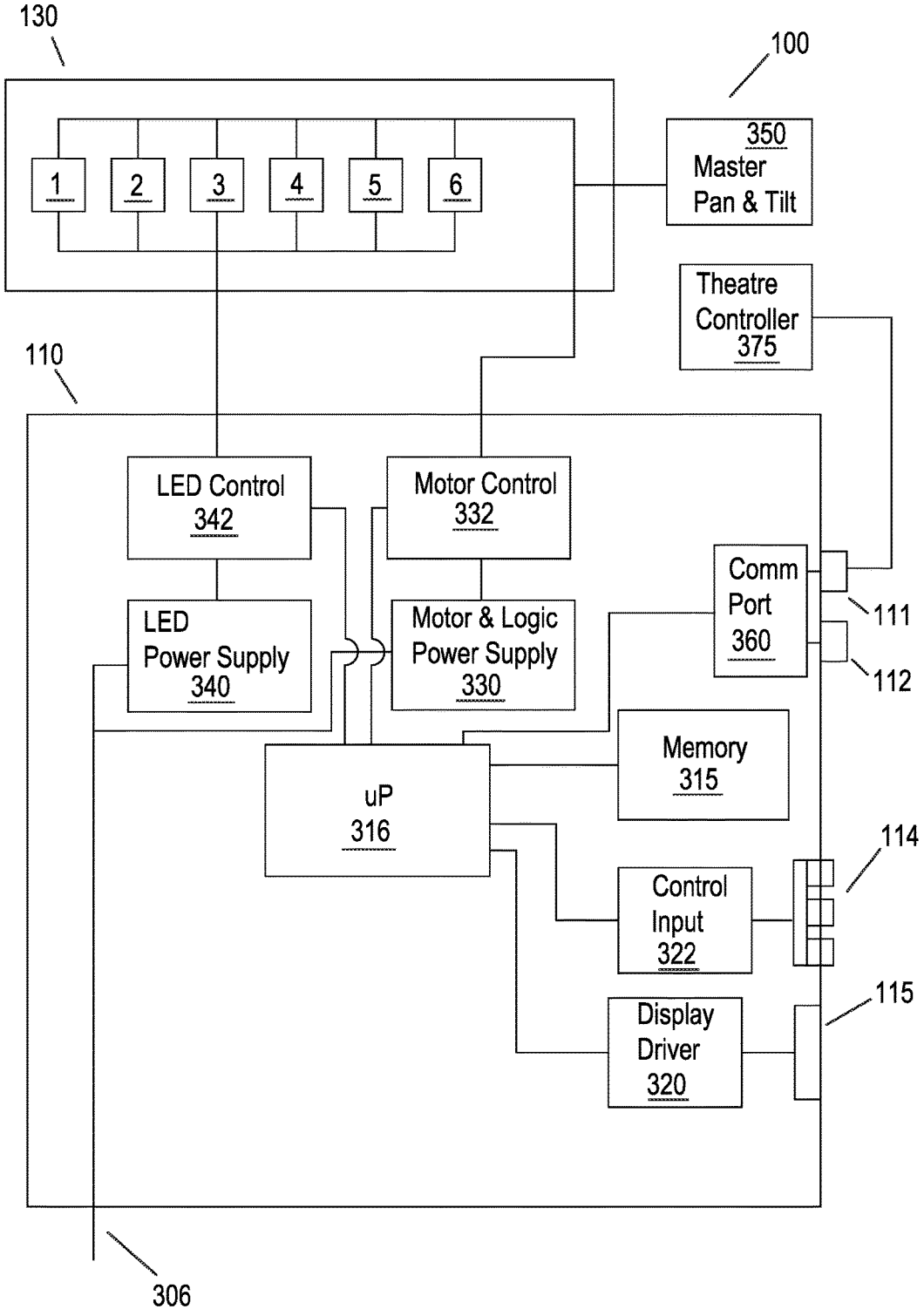
FIG. 9 shows an electrical diagram for use with the theatre lighting apparatus of FIG. 1 in at least one embodiment of the present invention.

FIG. 9 shows an electrical diagram 300 of the theatre lighting apparatus 100 of FIG. 1. A base housing 110 of the theatre lighting apparatus 100 has a means for accepting external power 306, which may be an electrical cord. External power is routed to the motor and logic supply 330 and the LED power supply 340. A theatrical controller 375 is shown connected to a communications input connector 111 of the theatre lighting apparatus 100 of FIG. 1. The theatre lighting apparatus 100 can be controlled to operate with the USITT (United States Institute of Theatre Technology) DMX 512 protocol. The USITT DMX protocol, as known in the art, is comprised of 512 control channels with each channel having two hundred and fifty-six selectable values. Other communications protocols can be used such as the Artnet protocol a trademark of and copyright by Artistic Licence Holdings Ltd that can be transmitted over Ethernet as known in the art. The communication connector 111 routes communication commands to a communications port 360 and sends the communication commands to a computer processor or microprocessor 316 where the commands are operated on by operating software stored in the memory or computer memory 315. The computer processor 316 can also operate on commands received by the control input 322 that is connected to user input keys 114 of the theatre lighting apparatus 100 of FIG. 1 located on the electronics housing 110. Visual confirmation of commands and input direction to the user is provided by the processor 316 working in conjunction with a display driver 320 and a user display 115 located on the electronics housing 110.

The processor 316 provides instructions based upon received commands from the communications port 360 to the motor control 332. The motor control 332 provides power and control of the motors of light source module devices 1, 2, 3, 4, 5, and 6, that operate the pan axis of modules 1, 2, 3, 4, 5, and 6, respectively. Each motor device, such as motor device 204 for module 1, and identical or similar motor devices for the other modules 2-6 has its own separate pivot mechanism, such as 208, that operates with a pan motor, not shown but part of lighting apparatus 100. Thus each motor device, such as motor device 204, for module 1, and similar or identical motor devices for modules 2-6 has one motor for panning for a total of six motors, one for each of modules 1-6. Each of the six motors (one for each module) can be remotely controlled to adjust the pan axis of each module of modules 1-6, separately. The motor control 332 also supplies power and controls the master pan and tilt motors 350 that position the lamp housing 130 in relation to the base housing 110.

The processor 316 provides instructions based upon received commands from the communications port 360 to the LED control 342. The LED control 342 of FIG. 9 based on those instructions can individually control the intensity (including on and off) separately and the variable color separately for each of the light emitting modules 1, 2, 3, 4, 5, and 6. In this way an operator of the theatrical controller 375 of FIG. 9 may individually control the intensity of each module 1, 2, 3, 4, 5, and 6. Also the LED control can vary the color of each of the light emitting modules 1, 2, 3, 4, 5 and 6 by varying the intensity of the red, green, blue and white multicolor LED light source 232 of FIG. 4.

The theatre lighting apparatus 100 of at least one embodiment of the present invention has a master pan and a master tilt parameter where the lamp housing 130 is positioned relative to the base housing 110 by panning and tilting and additionally, a module pan parameter for each of the modules 1, 2, 3, 4, 5, and 6. Thus for theatre lighting apparatus 100, there are six module pan parameters (for modules 1-6 versus lamp housing 130), and one master pan parameter (for lamp housing 130 versus base housing 110), and one master tilt parameter (for lamp housing 130 versus base housing 110).

Figure 5:
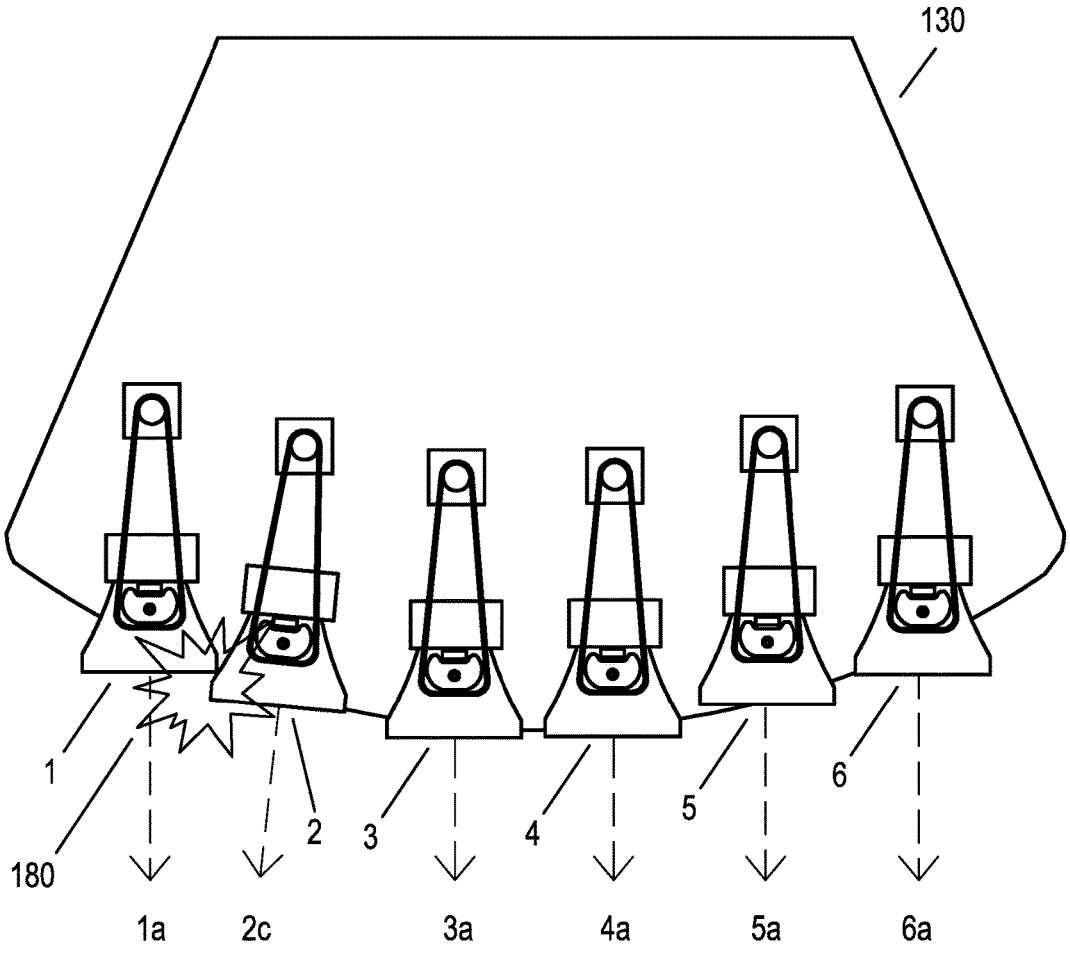
FIG. 5 shows a top view of a lighting housing of the theatre lighting apparatus of FIG. 1, in a third state in which all of the light emitting modules project light parallel to each other except for one, which has been rotated as far as it can be rotated to the left, but which is prevented from going any further to the left, i.e. it is restricted in movement by adjacent light emitting modules.

It is desirable to produce a theatre lighting apparatus 100 of compact dimensions. The theatre lighting apparatus 100 that is comprised of a plurality of light sources (or modules 1-6) can be made more compact by positioning the modules 1-6 close together on the same plane within the lamp housing so as to be able to create a fan effect. A problem next arises that with modules 1-6 closer together, when, for example, module 2 of FIG. 5 is remotely controlled by an operator of the theatrical controller 375 of FIG. 11 to change orientation and/or rotate, in for example a clockwise manner, to go from the zero position to a positive degree position there is a collision between module 1 and module 2, i.e. module 2 collides into or impacts with module as shown by collision or location 180, in FIG. 5 because modules 1 and 2 occupy a portion of the same space. It is unreasonable to expect the operator of the central controller 375 and the theatre lighting apparatus 100 of the invention to know a collision, such as collision 180, can occur. It is an objective of the theatre lighting apparatus 100 to be able have the modules 1-6 movable from a zero position like that shown in FIG. 2 to a fanned out position (or also seen as an arc) such as that illustrated by FIG. 3, without, in at least one embodiment, collisions occurring which can damage the modules 1-6 and make fanning out of the modules 1-6 difficult or impossible.

The inventors have conceived a compact theatre lighting apparatus that uses the microprocessor 316 in cooperation with the memory 315 to track the relative position of each of modules 1-6 of FIG. 1. Next by the use of anti-collision methods, such as by use of computer software stored in computer memory 315 and implemented by computer processor or microprocessor 316 of FIG. 9, it is possible to maintain the compact dimensions of the theatre lighting apparatus 100 yet avoid collisions by modules 1-6, which each other.

Figure 2:
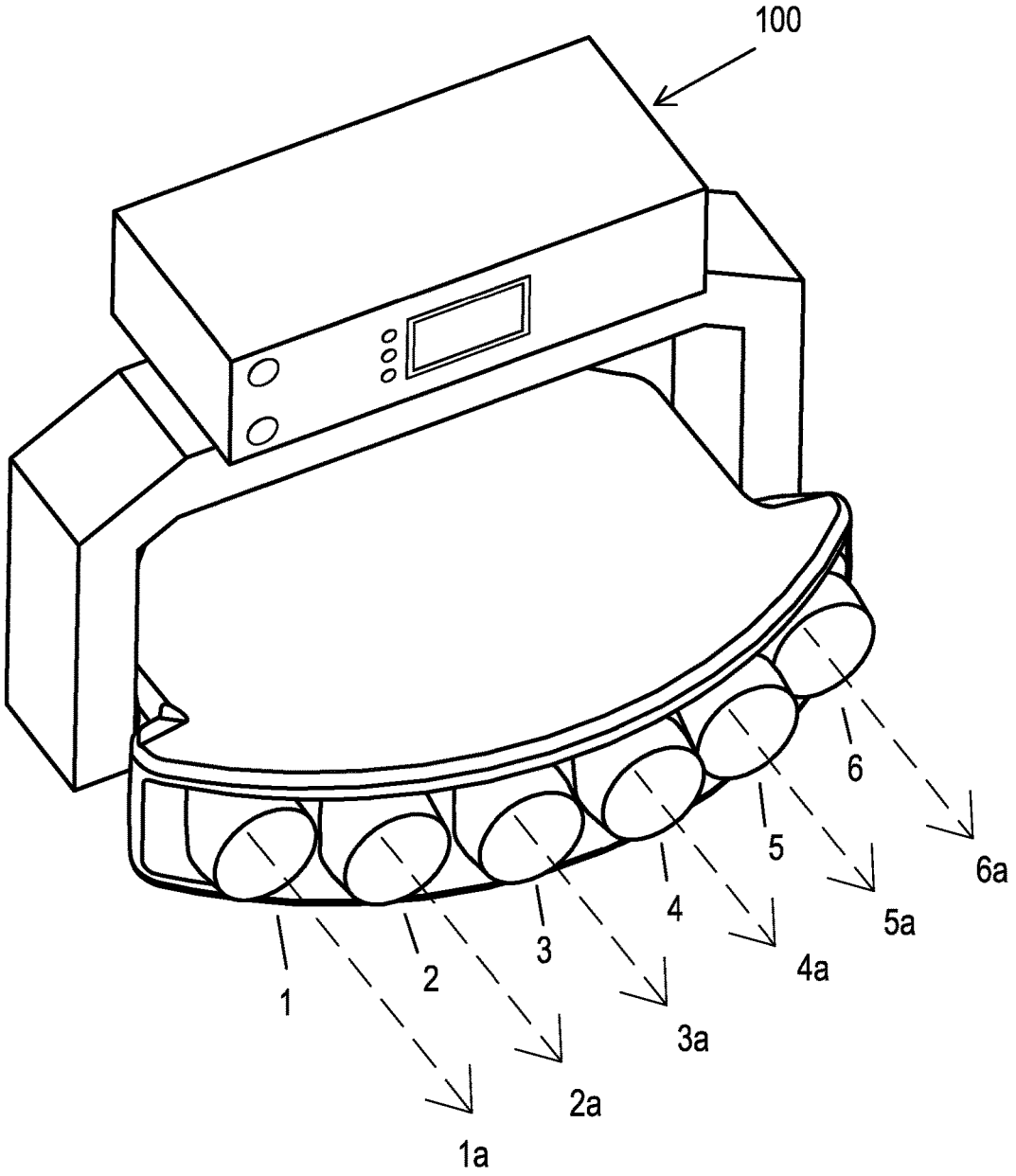
FIG. 2 shows a top, front, and left side perspective view of the theatre lighting apparatus of FIG. 1, with a plurality of light emitting modules of the theatre lighting apparatus projecting light parallel to each other, in the first state.

FIG. 2 shows the theatre lighting apparatus 100 with modules 1-6 at the home position and the modules 1-6 are parallel to each other. The home position, in at least one embodiment, may be orchestrated by computer software stored in computer memory 315 and by the use of known optical sensors or magnetic sensors. The home position is stored in the memory 315 of FIG. 9 as a zero position count value for each of modules 1-6. As each of modules 1-6 is positioned differently than the zero position count value by an operator of the central controller 350 of FIG. 11 the number of steps (or degrees) the motor 204 of FIG. 4 pivots the pivoting lens assembly 260 is counted (or tracked) and tallied information of the position count value is provided to the memory 315 by the computer processor 316.

In this way each of modules 1-6 of FIG. 9 position count value is accounted for by tracking the steps of the stepping motor 228 and the operating software in computer memory 315 is programmed, in accordance with an embodiment of the present invention, to determine if any of modules 1-6 of FIG. 9 should be restricted from moving to avoid collisions.

Figure 3:
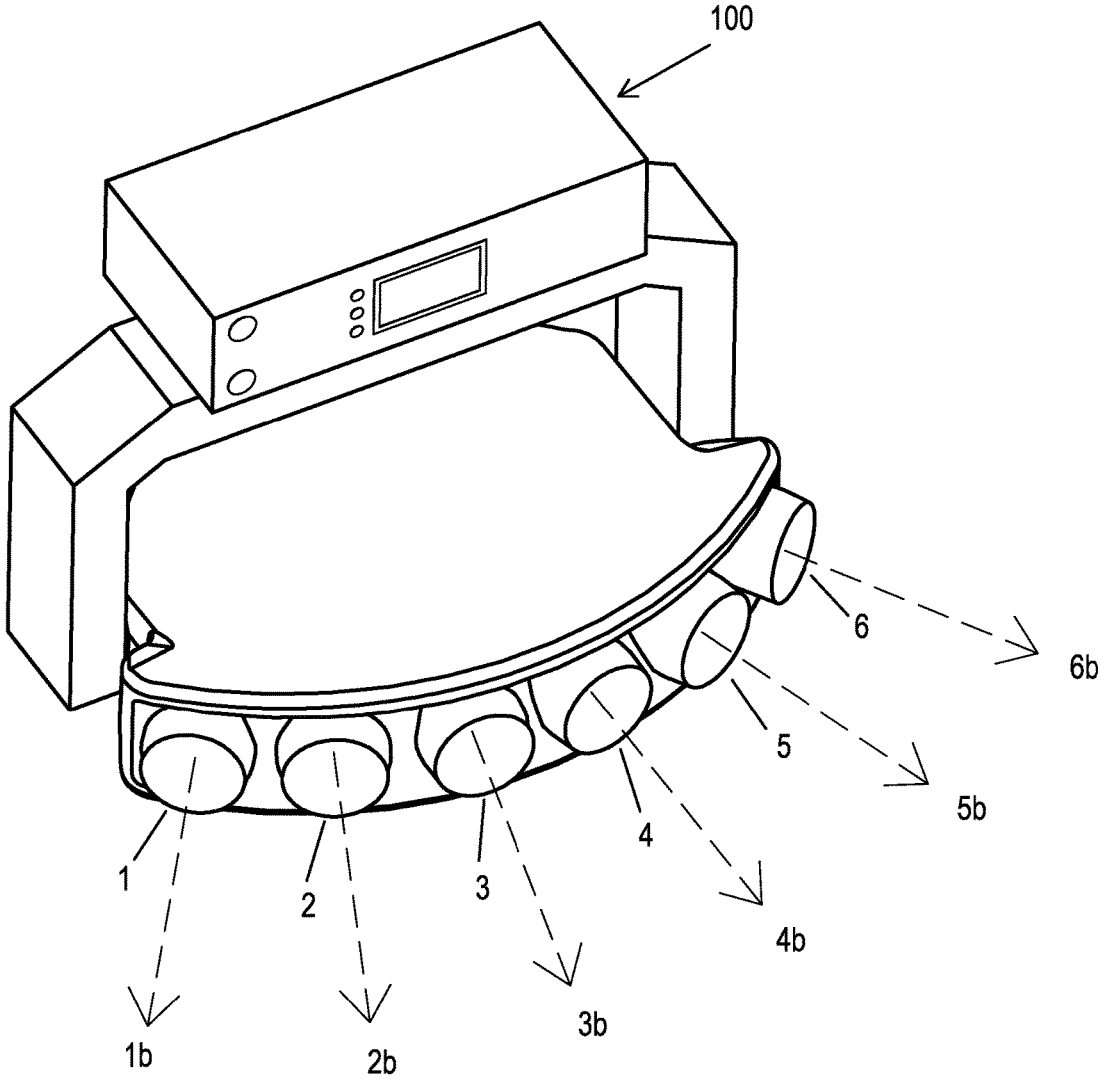
FIG. 3 shows a top, front, and left side perspective view of the theatre lighting apparatus of FIG. 1 with the plurality of light emitting modules emitting light not parallel to each other (such as in a fan pattern), in a second state.

FIG. 3 shows all modules 1-6 in their extended or "fan" position.

FIG. 4 shows the module 1 in detail. Each of the modules 2-6 may be identical or substantially similar to the module 1 of FIG. 4. In at least one embodiment, the module 1, shown in FIG. 4, includes a step or stepping motor 204, a pinion timing pulley 208, a drive belt 210, a partial timing pulley 230, a heat sink 228, an assembled lens 230, a multicolor LED light source 232, and a pivot point 240. The heat sink 228 is used for the cooling of the multicolor LED light source 232.

FIG. 5 shows what can happen when an operator of the theatre controller 375 operates the controller to remotely position the module 2 to rotate clockwise, or to the left, to move from the zero point position count value to a positive position count value without first moving module 1. A collision 180 occurs, between module 2 and module 1 as shown in FIG. 5 because module 2 and module 1 occupies a portion of the same space. The collision 180 is undesirable as it deemed as a malfunction and can be noisy in a theatrical environment.

Figure 6:
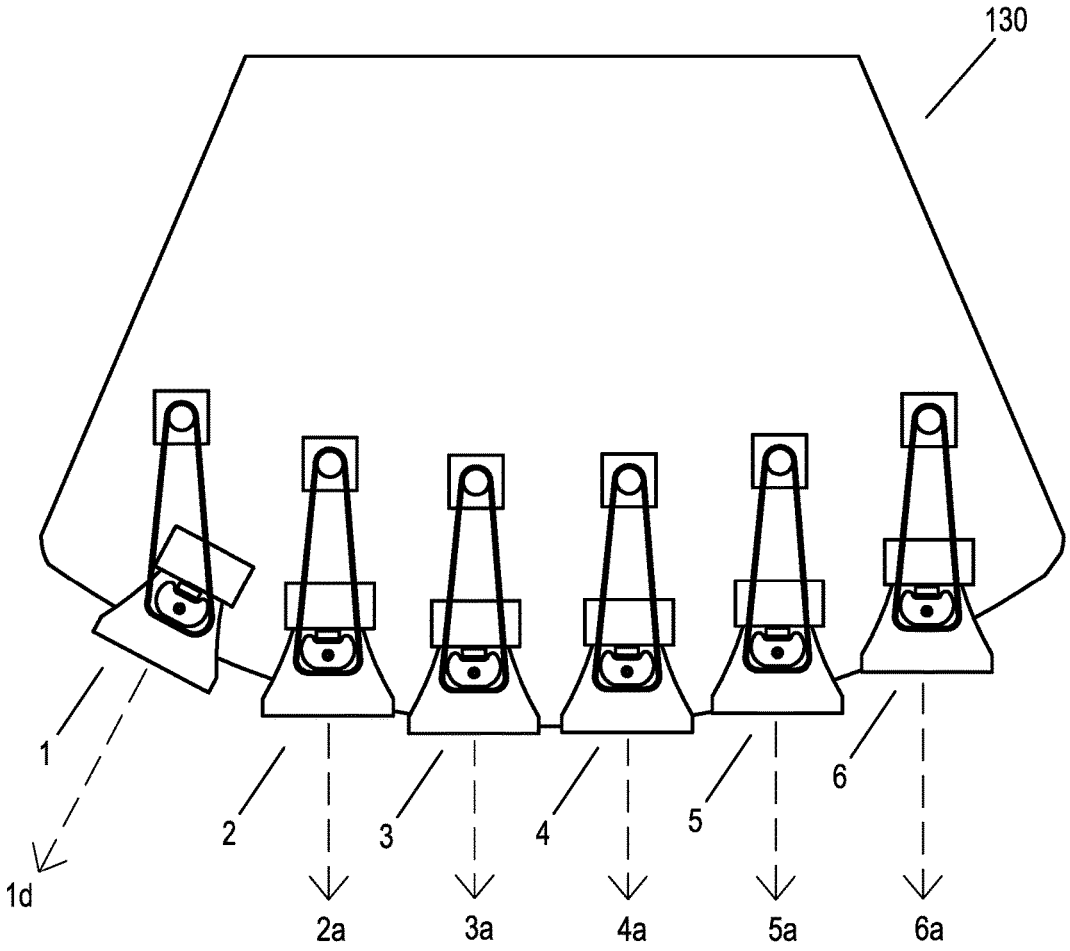
FIG. 6 shows a top view of the lighting housing of the theatre lighting apparatus of FIG. 1, in a fourth state in which all of the light emitting modules project light parallel to each other except for one, which has been rotated to the left, in order to make room for an adjacent light emitting module to rotate.

FIG. 6 shows that the operator of the theatre controller 375 must first command to move the module 1 to a positive position before module 2 is allowed to move to a positive position. The processor 316 using the anti-collision method, such as computer software methods and knowing the relative position count values of all modules 1-6 will not allow the operator of the theatre controller 375 to command and move the module 2 without first moving the module 1, if it is necessary to do so to avoid a collision.

In a step by step process in accordance with a method of an embodiment of the present invention:

(1) All of modules 1-6 are at zero position count value.
(2) The operator of the theatre controller 375 wishes to operate the theatre controller 375 to command the module 2 to rotate in the clockwise direction, or to move to an outward positive position and directs the command.
(3) The command to move or rotate module 2 is received by the communications port 360
(4) The communications port 360 relays the command to the processor 316.
(5) The processor or microprocessor 316 requests the position count value information from the memory 315.
(6) The position count values are provided as zero value for all modules 1-6.
(7) The computer processor 317 by the operating software determines by the position count values that module 2 is unable to move because module 1 is at a zero position count value. So the movement of module 2 is not allowed by the operating software.
(8) The operator finds that module 2 is unmovable and avoids and accidental collision.
(9) The operator with the use of the theatrical controller and microprocessor 316 shown in FIG. 9 moves module 1 to a positive position count value as shown in FIG. 6.
(10) The operator selects by the theatrical controller shown in FIG. 9 next to move module 2.
(11) The command to move module 2 is received by the communications port 360.
(12) The communications port 360 relays the command to the processor 316.
(13) The computer processor 316 request the position count value information from the memory 315.

(14) The position count values are provided as positive position count value for module 1 and zero for all modules 2-6.

Figure 7:
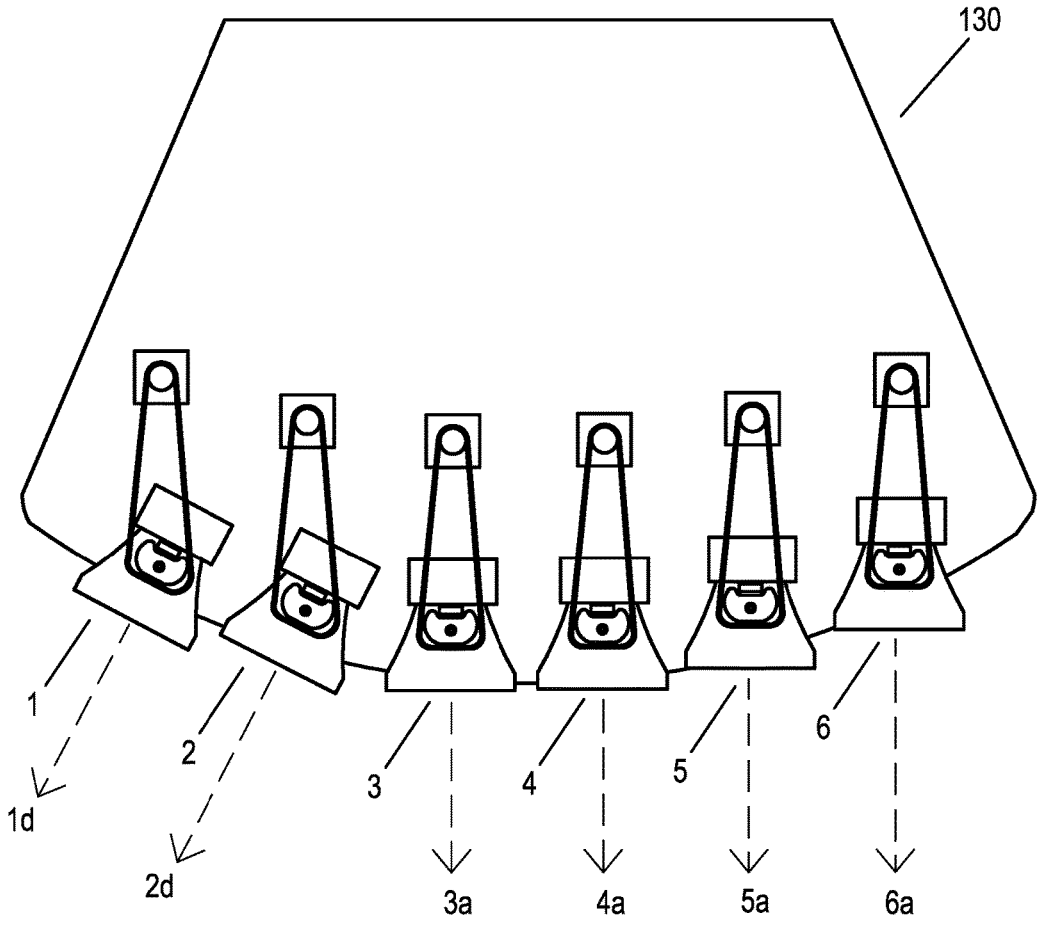
FIG. 7 shows a top view of the lighting housing of the theatre lighting apparatus of FIG. 1, in a fifth state in which all of the light emitting modules project light parallel to each other except for the two light emitting modules to the left, which have been rotated to the left, and the light emitting module second from the left is able to rotate further to the left (i.e. further than in FIG. 5), because the leftmost light emitting module has been rotated.

(15) The computer processor 317 by the operating software determines by the position count value that it allows the movement of module 2 without collision. The operator with the use of the theatrical controller 375 shown in FIG. 9, moves module 2 to a positive position count value as shown in FIG. 7.

Figure 8:
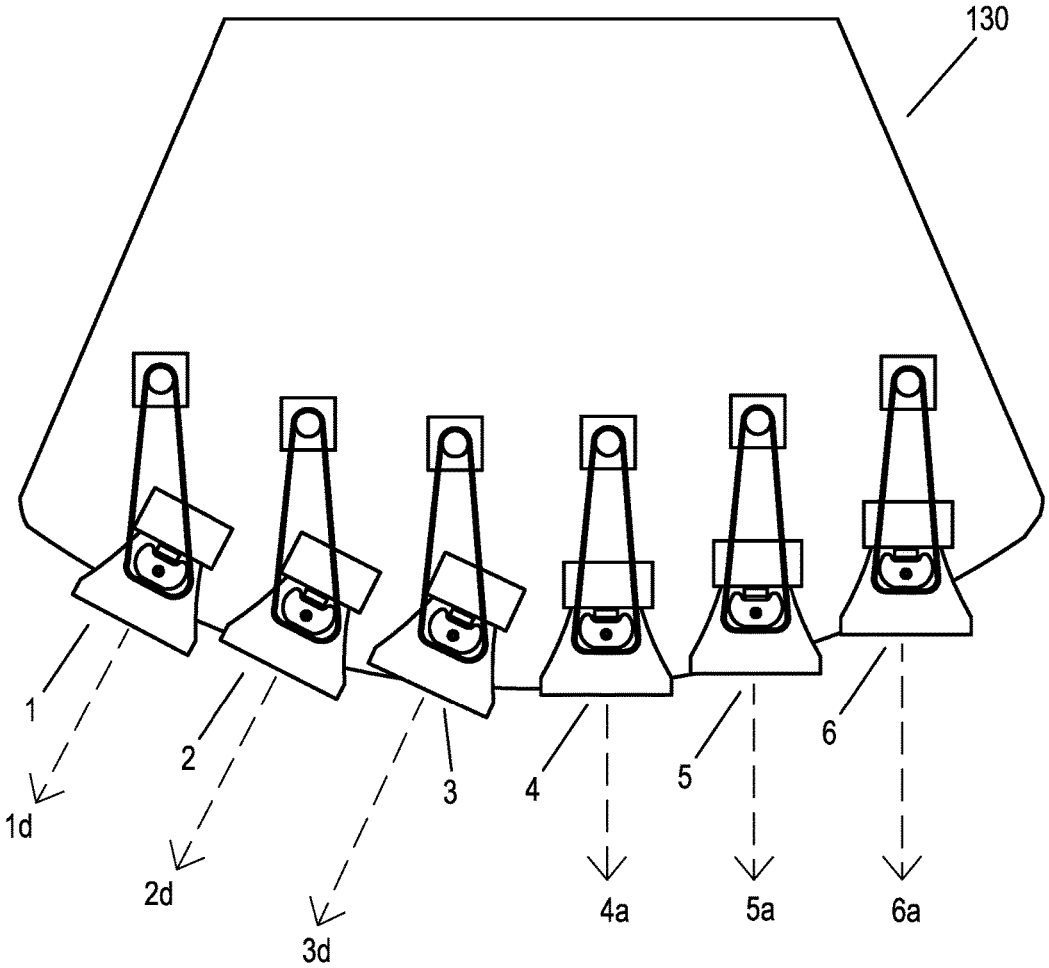
FIG. 8 shows a top view of the lighting housing of the theatre lighting apparatus of FIG. 1, in a sixth state in which all of the light emitting modules project light parallel to each other except for the three light emitting modules to the left, which have been rotated to the left, and the light emitting module second, and third from the left, are able to rotate further to the left (i.e. further than in FIG. 5), because the light emitting module to their left has been rotated.

16) The operator may also select by the theatrical controller 375 to move module 3 to position 3*d* as shown in FIG. 8 since the processing system 316 of FIG. 9 with the use of the operating software has determined by the stored position count value in the memory 315 that module 2 is in a positive position count value and no collision will occur.

Although the invention has been described by reference to particular illustrative embodiments thereof, many changes and modifications of the invention may become apparent to those skilled in the art without departing from the spirit and scope of the invention. It is therefore intended to include

We claim:

1. A theatrical apparatus comprising:

a first light source, and a second light source;

a computer memory, and a computer processor;

wherein computer operating software is stored in the computer memory and is configured to be executed by the computer processor;

wherein the first light source has a current position;

wherein the second light source has a current position;

wherein the first light source is configured to be remotely operated by the computer processor executing the computer operating software to have its current position changed from a first position to a second position, if the current position of the second light source is a third position; and wherein to prevent the first light source from colliding with the second light source, the first light source is prevented by the computer operating software from having its current position changed from the first position to the second position, if the current position of the second light source is a fourth position, which is different from the third position; and wherein changing the current position of the first light source from the first position to the second position, while the current position of the second light source is in the fourth position would cause the first light source and the second light source to collide.

2. The apparatus of claim 1 further comprising a third light source;

wherein the third light source has a current position;

wherein the first light source is located in between the second light source and the third light source;

wherein the first light source is configured to be remotely operated by the computer processor executing the computer operating software to have its current position changed from the first position to a fifth position, if the current position of the third light source is a sixth position; and wherein the first light source is prevented by the computer operating software from having its current position changed from the first position to the fifth position, if the current position of the third light source is a seventh position, which is different from the sixth position; and wherein changing the current position of the first light source from the first position to the fifth position, while the current position of the second light source is in the seventh position would cause the first light source and the third light source to collide.

3. The apparatus of claim 2 wherein the first light source is prevented by the computer operating software from having its current position changed from the first position to the second position, if the current position of the second light source is the fourth position, by preventing any movement of the first light source from the first position towards the second position; and wherein the first light source is prevented by the computer operating software from having its current position changed from the first position to the fifth position, if the current position of the third light source is the seventh position, by preventing any movement of the first light source from the first position towards the fifth position.

4. The apparatus of claim 3 wherein the first light source in the first position is parallel to the second light source in the fourth position, and is parallel to the third light source in the seventh position.

5. The apparatus of claim 2 wherein the first light source in the first position is parallel to the second light source in the fourth position, and is parallel to the third light source in the seventh position.

6. The apparatus of claim 1 wherein the first light source is prevented by the computer operating software from having its current position changed from the first position to the second position, if the current position of the second light source is the fourth position, by preventing any movement of the first light source from the first position towards the second position.

7. The apparatus of claim 1 wherein the first light source in the first position is parallel to the second light source in the fourth position.

8. A theatrical apparatus comprising:

a first light source, and a second light source;

a computer memory, and a computer processor;

wherein computer operating software is stored in the computer memory and is configured to be executed by the computer processor;

wherein the first light source has a current position;

wherein the first light source is configured to be remotely operated by the computer processor executing the computer operating software to have its current position changed from a first position to a second position, independent of the second light source;

wherein the second light source has a current position;

wherein the second light source is configured to be remotely operated by the computer processor executing the computer operating software to have its current position changed from a third position to a fourth position, independent of the first light source;

wherein data indicating the current position of each of the first, and the second light sources, including a position count value for each of the first, and the second light sources, is stored in the computer memory by the computer processor executing the computer operating software;

wherein the first light source cannot be moved from the first position to the second position, while the second light source is in the third position, without colliding with the second light source;

wherein the position count value of the first light source and the position count value of the second light source are used by the computer operating software to prevent the first light source and the second light source from colliding with each other.

9. The theatrical apparatus of claim 8 wherein the first light source is configured to be remotely operated by the computer processor executing the computer operating software to have the current position of the first light source changed from a first position to a second position by a theatrical controller.

10. The theatrical apparatus of claim 9 wherein the first light source is configured to be remotely operated by the computer processor executing the computer operating software which includes command protocol, which is the DMX protocol, as transmitted by the theatrical controller to the computer processor.

11. The theatrical apparatus of claim 9 wherein the first light source is configured to be remotely operated by the computer processor executing the computer operating software which includes command protocol, which is the Artnet Protocol, as transmitted by the theatrical controller to the computer processor.

12. The theatrical apparatus of claim 8 wherein the first light source is prevented by the computer operating software from having its current position changed from the first position to the second position, if the current position of the second light source is in the third position, by preventing any movement of the first light source from the first position towards the second position.

13. A method of operating a theatrical lighting system comprising the steps of:

changing a current position of a first light source from a first position to a second position remotely by use of a computer processor implementing operating computer software stored in a computer memory;

changing a current position of a second light source from a third position to a fourth position remotely by use of the computer processor implementing the operating computer software stored in the computer memory;

wherein the first light source, and the second light source are part of a theatrical apparatus;

wherein the current position of the first light source is changed without changing the current position of the second light source;

wherein the current position of the second light source is changed without changing the current position of the first light source;

wherein the first light source cannot be moved from the first position to the second position, while the second light source is in the third position, without colliding with the second light source;

wherein data indicating the current position of each of the first, and the second light source, including a position count value for each of the first, and the second light sources, is stored in the computer memory by the computer processor as programmed by the operating computer software;

wherein the position count value of the first light source and the position count value of the second light source are used by the operating computer software to prevent the first light source and the second light source from colliding with each other.

14. The method of claim 13 wherein the first light source is configured to be remotely operated by the computer processor implementing the operating computer software to have the current position of the first light source changed from the first position to the second position by a theatrical controller.

15. The method of claim 14 wherein the first light source is configured to be remotely operated by command protocol, which is the DMX protocol, as transmitted by the theatrical controller to the computer processor.

16. The method of claim 14 wherein the first light source is configured to be remotely operated by command protocol, which is the Artnet Protocol, as transmitted by the theatrical controller to the computer processor.

17. The method of claim 13 further comprising changing a current position of a third light source from a fifth position to a sixth position remotely by use of the computer processor implementing the operating computer software stored in the computer memory;

changing the current position of the first light source from the first position to a seventh position remotely by use of the computer processor implementing the operating computer software stored in the computer memory;

wherein the third light source is part of the theatrical apparatus;

wherein the current position of the third light source is changed without changing the current position of the first and second light sources wherein the current position of the first light source is changed without changing the current position of the second and third light sources;

wherein the current position of the second light source is changed without changing the current position of the first and third light sources;

wherein the first light source cannot be moved from the first position to the seventh position, while the third light source is in the fifth position, without colliding with the third light source;

wherein data indicating the current position of the third light source, including a position count value for the third light source is stored in the computer memory by the computer processor as programmed by the operating computer software; and wherein the computer processor implements the operating computer software to use the position count value of the third light source and the position count value of the first light source to prevent a collision of the third light source and the first light source.

18. A method of operating a theatrical lighting system comprising:

changing a current position of a first light source from a first position to a second position remotely by use of a computer processor implementing a computer program stored in a computer memory;

changing a current position of a second light source from a third position to a fourth position remotely by use of a computer processor implementing a computer program stored in a computer memory;

changing a current position of a third light source from a fifth position to a sixth position remotely by use of a computer processor implementing a computer program stored in a computer memory;

wherein the first light source cannot be moved from the first position to the second position, while the second light source is in the third position, without colliding with the second light source;

wherein the first light source cannot be moved from the first position to a seventh position, while the third light source is in the fifth position, without colliding with the third light source;

wherein the computer program prevents the first light source from colliding with the second light source and the first light source from colliding with the third light source;

wherein the first light source, the second light source, and the third light source are part of a lamp housing;

wherein the lamp housing is rotatably mounted to a base;

wherein the lamp housing has a front arc having a radius;

wherein the first, second, and third light sources are arranged along the front arc; and wherein the first, second and third light sources pivot on the same plane.

* * * * *